United States Patent [19]

Power et al.

[11] 4,095,057

[45] June 13, 1978

[54] FREQUENCY RESPONSE TESTING APPARATUS

[75] Inventors: Ronald Frederick Power, Rayleigh; Alan Anthony Barker, Gravesend; Michael Charles Martin, Kingston-upon-Thames; Brian Clifford Grover, Woking, all of England

[73] Assignee: National Research Development Corporation, London, England

[21] Appl. No.: 775,941

[22] Filed: Mar. 9, 1977

[30] Foreign Application Priority Data

Mar. 19, 1976 United Kingdom ..... 11182/76

[51] Int. Cl.[2] ..... H04R 29/00

[52] U.S. Cl. ..... 179/175.1 A; 324/57 SS

[58] Field of Search ..... 179/175.1 A, 175, 175.3 R; 324/57 SS, 57 DE, 77 C, 77 CS

[56] References Cited

U.S. PATENT DOCUMENTS

| | | | |
|---|---|---|---|
| 3,093,711 | 6/1963 | Comerci et al. | 179/175.1 A |
| 3,267,222 | 8/1966 | Chipp et al. | 179/175.1 A |
| 3,692,959 | 9/1972 | Lamp | 179/175.1 A |
| 3,922,506 | 11/1975 | Frye | 179/175.1 A |

*Primary Examiner*—Douglas W. Olms

*Attorney, Agent, or Firm*—Cushman, Darby & Cushman

[57] ABSTRACT

Frequency response testing apparatus, developed for use with hearing aids, comprises a generator providing a predetermined varying-frequency input for the device under test, and a discriminator which applies incremental output level signals from the device to a display matrix of LED's under the control of timing signals derived from the generator, the overall arrangement providing a display in the form of a linear graphical plot.

11 Claims, 3 Drawing Figures

FREQUENCY RESPONSE TESTING APPARATUS

Figure 1:
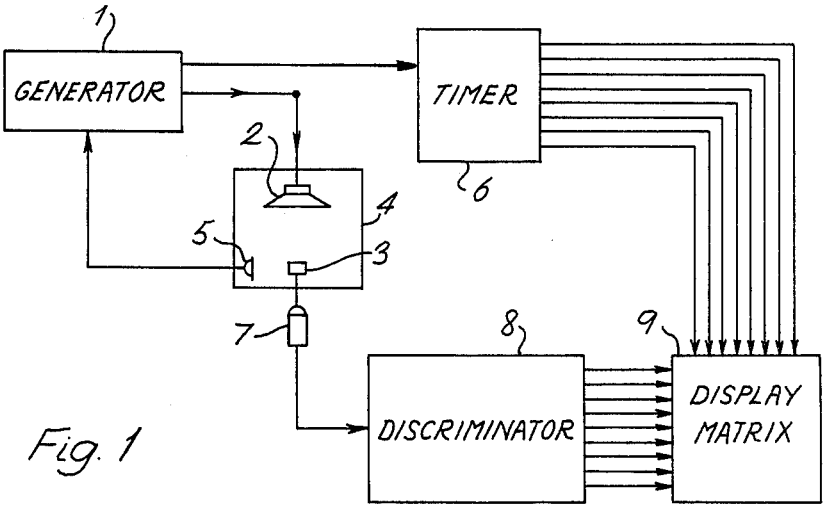

This invention concerns frequency response testing apparatus and more particularly, but not exclusively, such apparatus for testing the frequency response of acoustic devices.

In practice the invention has been developed for testing hearing aids, but it will be appreciated that the invention is equally applicable to the testing of other electroacoustic devices, such as microphones and loudspeakers. Indeed the invention is more generally applicable to the testing of an electrical device required to exhibit a predetermined frequency response in its operating characteristics. Examples of such devices which are non-acoustic include amplifiers and filters.

Currently available apparatus such as used to test the frequency response of a hearing aid commonly takes one of two general forms. In one of these forms the apparatus is relatively simple and involves successive testing at progressively varied discrete frequencies to provide data from which a graphical plot of the relevant response can be prepared manually. This is clearly disadvantageous in terms of the time taken to test a device. The other form of apparatus avoids this disadvantage only by greater complexity which is itself disadvantageous in terms of the consequent cost and a need for skilled operators.

An object of the present invention is to reduce these disadvantages and to this end, there is provided frequency response testing apparatus comprising a generator for providing a first electrical signal of predetermined varying-frequency form representing an input for application to a device to be tested; a receiver for response to a second electrical signal representing the output of said device when subjected to said input, said receiver including timing means connected to said generator to provide a plurality of sequentially occurring third electrical signals representing correspondingly occurring increments of said first signal, discriminating means responsive to said second signal to provide a plurality of fourth electrical signals respectively representing successively increasing amplitude levels therein; and a matrix of electrically-operable light-emitting elements, successive columns and rows of said elements being respectively connected for response to corresponding ones of said third and fourth signals, and each of said elements being operable only in response to the simultaneous occurrence of the respective ones of said third and fourth signals.

It will be appreciated that the proposed apparatus operates to provide automatically, by way of the matrix, a visual representation of the second signal in graphical form and this facilitates the testing procedure. In practice, it will usually be desirable that the first signal be provided in a repetitive sequence to give rise to a correspondingly repeated display at the matrix, or the first signal be provided singly and the matrix be adapted to hold its display.

Also, it will be appreciated that, when the device to be tested is of electroacoustic form, the apparatus comprises an electroacoustic coupling. It is, in any case, preferred that the apparatus comprises a feedback circuit and attenuator whereby the first signal is controlled to provide an input to the device under test, of constant amplitude in terms of voltage, current, or sound pressure, and this feedback can also include an electroacoustic coupling.

Figure 2:
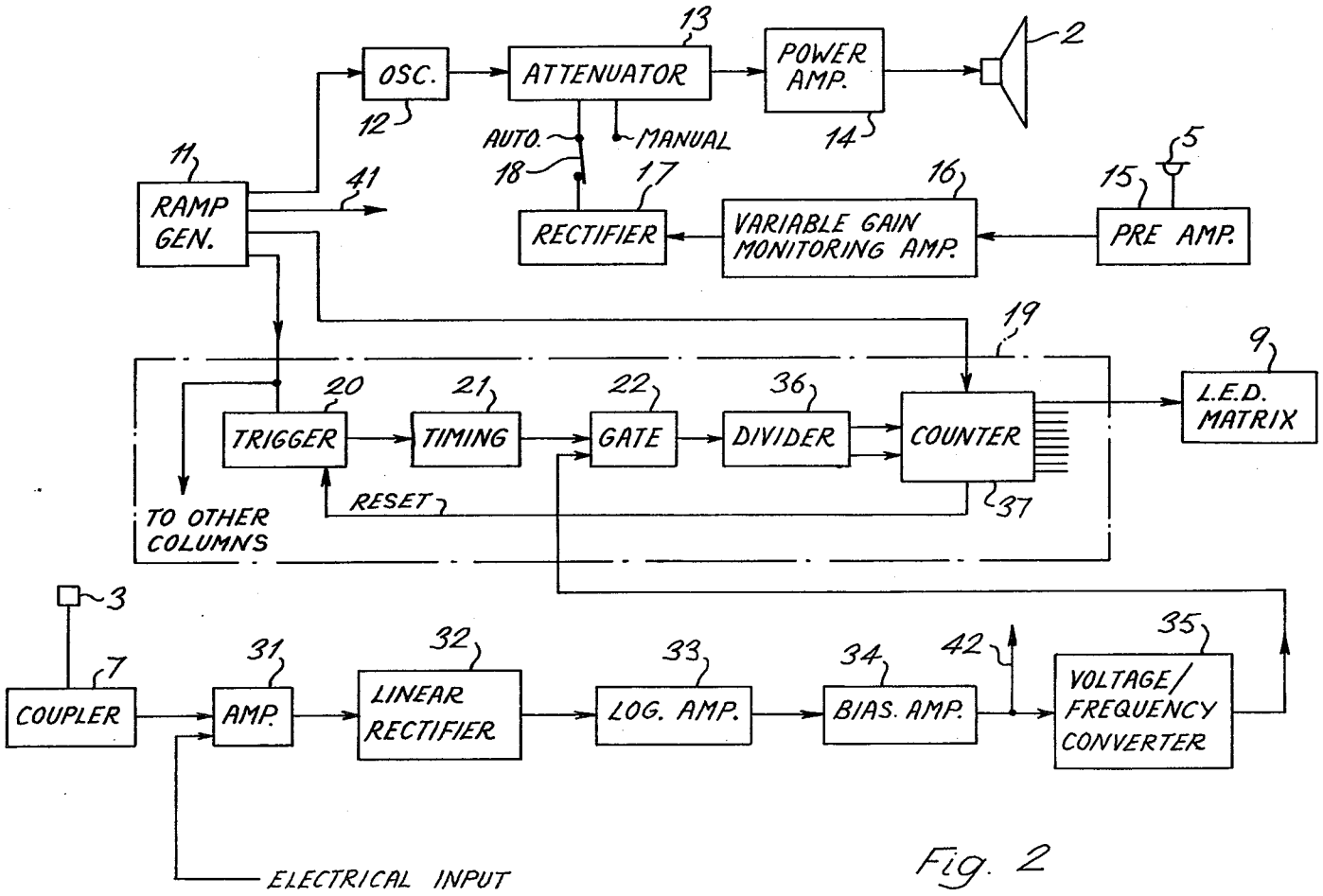

These and other features of the invention will be more fully understood from the following description, given by way of example, with reference to the accompanying drawings, in which:

FIG. 1 schematically illustrates one embodiment of the present invention;

FIG. 2 similarly illustrates part of FIG. 1 in more detail; and

Figure 3:
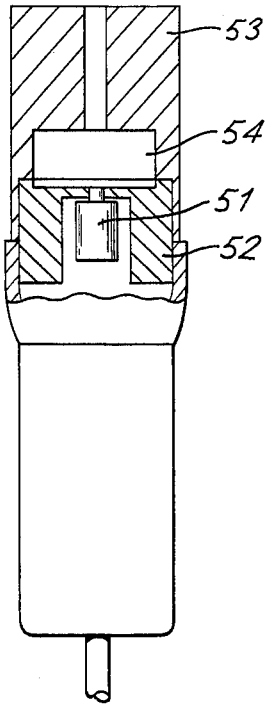

FIG. 3 similarly illustrates another part of FIG. 1 in more detail.

The illustrated embodiment serves for testing hearing aids and FIG. 1 illustrates the overall apparatus very generally, while FIGS. 2 and 3 respectively illustrate electrical and coupling parts of the apparatus in more detail.

In FIG. 1 a generator for generating a first electrical signal of predetermined frequency form is denoted at 1, and this signal is applied to a loudspeaker 2 to provide an audio input for a hearing aid 3. The loudspeaker 2 and hearing aid 3 are located in an acoustic test box 4 and represent a first acoustic coupling.

The test box 4 also houses a microphone 5 which responds to the loudspeaker 2 to form a second acoustic coupling which provides a feedback signal applied to the generator 1. This feedback signal controls the output of the generator 1 so that the loudspeaker 2 provides a corresponding output at constant sound pressure.

The output from the generator 1 is additionally applied to a timer 6 which provides a plurality of sequentially occurring electrical signals representing correspondingly occurring increments of the generator output.

The hearing aid output is applied by way of a $2cm^3$ acoustic coupler 7, or an artificial mastoid in the case of an aid of bone conduction type, to discriminator 8 which operates to provide a plurality of electrical signal outputs respectively representing successively increasing amplitude levels of the input thereto.

The remaining part of FIG. 1 is a matrix 9 of electrically-operable light-emitting elements of which the successive columns and rows are respectively connected for response to corresponding outputs of the timer and discriminator. The elements of the matrix are operable only in response to simultaneous occurrence of the respective ones of the timer and discriminator output signals so that, during the first increment of operation of the generator 1, the element which is disposed in the first column of the matrix and also represents the output amplitude of the hearing aid at that time as illuminated, and so on. Thus, the matrix is operated to provide a visual representation in graphical form of the response of the hearing aid to the generator signal.

Turning to the additional detail of FIG. 2: the generator 1 is seen to comprise a ramp generator 11 which applies a D.C. sawtooth voltage to control the frequency of an oscillator 12 in a predetermined progressively increasing manner. The oscillator output is applied, by way of an attenuator 13 and amplifier 14, to the loudspeaker 2. The attenuator 13 is operated to control the loudspeaker output to a constant sound pressure, this being effected by feedback, from the microphone 5, through a pre-amplifier 15, variable gain monitoring amplifier 16, and rectifier 17. A switch 18 is connected between the rectifier and attenuator to allow disconnection of automatic feedback control and resort to manual control of the attenuator.

The timer 6 comprises a plurality of similar sets of circuits 19 one set for each column of the matrix 9, of which only one set need be described in detail. Each set includes a trigger circuit 20 operable in response to a predetermined voltage threshold in the output of ramp generator 11, the trigger circuits associated with successive columns being operable at successively increasing threshold levels. The trigger circuit operates a timing circuit 21 to produce an output for a predetermined duration normally terminating no later than when attainment of the next trigger circuit threshold occurs in the ramp generator output. The timing circuit is connected to open, during its period of operation, a gate circuit 22.

The discriminator 8 is connected to the coupler 7 by way of an amplifier 31 and comprises a linear rectifier 32 to rectify signals of common amplitude, but varying frequencies, to corresponding D.C. levels. This rectifier is connected, through a logarithmic amplifier 33 and bias amplifier 34, to a voltage-to-frequency converter 35. The amplifier 33 compresses the possibly large range of received input and facilitates representation of the final output in a decibel scale, the amplifier 34 biases the compressed input into the input range of the converter 35, and the converter provides a pulse train output at a frequency related to the input amplitude. This pulse train is applied to the gate circuit 22 to be passed thereby, for the duration of the associated timing circuit input thereto, through a frequency divider 36, to a counter 37. The operation of the counter is additionally directly controlled by the ramp generator 11, and the counter outputs representing successive counts are respectively applied to the elements in the corresponding rows and the relevant column of the matrix 9.

In practical development of the invention, an embodiment such as described so far has been successfully constructed and operated with: an output from the oscillator 12 which varies from 0 to 5 kHz; attenuation of the oscillator output to provide an output from the loudspeaker which is at any of a plurality of selector values within a 40dB range; and a matrix of light-emitting diodes, which matrix has eight columns and nine rows, the rows representing a 45dB range in 5dB intervals. In the embodiment in question, alternative operating modes are available whereby the ramp generator provides a single frequency-sweep output and the matrix display is held thereafter, or the ramp generator provides a cyclically swept output with repetitive display at the matrix. Also, the relevant embodiment allows for additional facilities, such as an X–Y plotter or pen recorder controlled from additional outputs 41 and 42 of the ramp generator and bias amplifier.

The remaining FIG. 3 shows a presently preferred form for the coupler 7 of FIG. 1. This coupler should accord with the appropriate international standard, IEC 126, which requires, inter alia, that the hearing aid under test be coupled, by way of an ear mould substitute and then a cylindrical cavity of $2cm^3 \pm 1\%$, with a suitable calibrated microphone. Conventionally the ear mould substitute and the microphone are mounted directly in a housing to define therewith the cavity, and the microphone is of relatively expensive capacitor form. In the present case, a relatively low-cost miniature microphone 51 of the hearing aid type is used and this microphone is mounted in the centre of a rigid baffle 52 connected with an integrated ear mould/housing component 53 so that the baffle 52 and the component 53 define the relevant cylindrical cavity 54 without involvement of the microphone for this purpose.

We claim:

1. Frequency response testing apparatus comprising a generator for providing a first electrical signal of predetermined varying-frequency form representing an input for application to a device to be tested:

a receiver for response to a second electrical signal representing the output of said device, said receiver including timing means connected to said generator to provide a plurality of sequentially occurring third electrical signals representing correspondingly occurring increments of said first signal;

discriminating means responsive to said second signal for providing a plurality of fourth electrical signals respectively representing successively increasing amplitude levels therein;

and a matrix of electrically-operable light-emitting elements, successive columns and rows of said elements being respectively operably responsive to corresponding ones of said third and fourth signals, and each of said elements being operable only in response to the simultaneous occurrence of the respective ones of said third and fourth signals.

2. Apparatus according to claim 1 comprising electroacoustic means connected to at least one of said generator and said receiver to operably couple said device between said generator and said receiver.

3. Apparatus according to claim 2 wherein said electroacoustic means comprise a loudspeaker connected to said generator, and a microphone connected to said receiver.

4. Apparatus according to claim 3 wherein said microphone is of miniature, hearing aid type, said microphone is mounted in the centre of a rigid baffle, said baffle is connected with an ear mould substitute, and said baffle and said ear mould substitute define therebetween the cavity of a 2 $cm^3$ coupler according to the international standard IEC 126.

5. Apparatus according to claim 1 comprising a feedback circuit including an attenuator connected to said generator, and control means connected to said attenuator, said control means being operable in response to the output of said device to maintain, by way of said attenuator, the input to said device at constant amplitude.

6. Apparatus according to claim 5 wherein said feedback circuit comprises further electroacoustic means connected to at least one of said attenuator and said control means to operably couple said device with said circuit.

7. Apparatus according to claim 6 wherein said further electroacoustic means comprise a loudspeaker connected to said attenuator, and a microphone connected to said attenuator.

8. Apparatus according to claim 1 wherein:

said generator comprises a ramp generator providing a sawtooth output signal, and a variable-frequency oscillator connected with said ramp generator to provide said first signal in response to said sawtooth signal;

said timing means comprises a plurality of similar timing circuits, each including a trigger connected to said ramp generator to provide a respective one of said third signals in response to corresponding levels in said sawtooth signals, and a gate connected with said trigger to be opened for the duration of said one third signal;

said discriminating means comprises a linear amplifier responsive to said second signal to rectify increments thereof of common amplitude, but varying frequencies, to corresponding DC levels, and a voltage-to-frequency converter having its input connected to said linear rectifier to provide said fourth signals, and having its output connected to said gate of each of said timing circuits for passage therethrough when open;

and said matrix has successive ordinates connected to respective extensions of said timing circuits, which extensions each comprise a counter having its input connected with the respective gate for operation by the respective fourth signal, and its successive count outputs connected to successive elements of the respective ordinate of said matrix.

9. Apparatus according to claim 8 wherein said discriminating means comprises a logarithmic amplifier connected between said rectifier and said converter.

10. Apparatus according to claim 8 wherein the elements of said matrix comprise light-emitting diodes.

11. Frequency response testing apparatus comprising:

a waveform generator for providing an electrical signal having a linearly increasing frequency, representative of an input for application to a device to be tested;

means responsive to a signal indicative of the output signal of said device for generating a signal indicative of the amplitude of said device output signal;

a matrix of electrically-operable light-emitting elements, interconnected in columns and rows; and means responsive to a signal indicative of said increasing frequency signal and said signal indicative of said device output signal, for selectively activating respective elements in said matrix disposed in columns in accordance with said frequency varying signal and rows in accordance with said tested device output signal amplitude, to provide thereby a display of the frequency response of said tested device.

* * * * *